US006039041A

United States Patent [19]

Barth

[11] Patent Number: 6,039,041

[45] Date of Patent: Mar. 21, 2000

[54] METHODS OF FABRICATING A VENT/ INTAKE SYSTEM FOR A FUEL-FIRED, DIRECT VENT HEATING APPLIANCE

[75] Inventor: James T. Barth, Plano, Tex.

[73] Assignee: Selkirk, Inc., Dallas, Tex.

[21] Appl. No.: 09/314,440

[22] Filed: May 19, 1999

[51] Int. Cl.[7] ..... F24C 3/00

[52] U.S. Cl. ..... 126/85 B; 126/80; 126/312; 126/318

[58] Field of Search ..... 126/85 B, 84, 126/80, 312, 314, 315, 318, 307 R, 98, 292, 293

[56] References Cited

U.S. PATENT DOCUMENTS

| | | | |
|---|---|---|---|
| 1,059,600 | 4/1913 | Fisher . | |
| 2,647,477 | 8/1953 | Martin | 110/147 |
| 2,754,816 | 7/1956 | Ryder | 126/307 |
| 2,898,839 | 8/1959 | McKann | 98/48 |
| 2,966,838 | 1/1961 | Thompson et al. | 98/62 |
| 2,985,091 | 5/1961 | Hatcher | 98/46 |
| 3,052,230 | 9/1962 | Conrad | 126/307 |
| 3,361,125 | 1/1968 | Hershey | 126/116 |
| 3,435,816 | 4/1969 | De Werth | 126/85 |
| 3,450,128 | 6/1969 | Wilkins | 126/307 |
| 3,628,521 | 12/1971 | Hodges | 126/85 B |
| 3,643,646 | 2/1972 | Honaker, Jr. | 126/85 B |
| 4,249,758 | 2/1981 | Harris | 285/158 |
| 4,509,681 | 4/1985 | Kogut | 237/53 |
| 4,522,191 | 6/1985 | Knowles et al. | 126/307 R |
| 4,569,110 | 2/1986 | Goettel | 126/292 |
| 4,608,963 | 9/1986 | Townsend et al. | 126/307 R |
| 4,865,013 | 9/1989 | Teakell | 126/307 R |
| 4,878,481 | 11/1989 | Schoeff et al. | 126/307 R |
| 5,158,328 | 10/1992 | Anderson et al. | 285/168 |
| 5,282,456 | 2/1994 | Smelcer et al. | 126/85 B |
| 5,421,774 | 6/1995 | Specht | 454/45 |
| 5,445,137 | 8/1995 | Crews | 126/59 |
| 5,460,162 | 10/1995 | Binzer | 126/85 B |
| 5,590,641 | 1/1997 | Duong | 126/85 B |
| 5,680,856 | 10/1997 | Van Dijk | 126/85 B |
| 5,715,808 | 2/1998 | Wilhoite | 126/85 B |

*Primary Examiner*—Ira S. Lazarus
*Assistant Examiner*—Josiah C. Cocks
*Attorney, Agent, or Firm*—Konneker & Smith, P.C.

[57] ABSTRACT

A sheet metal colinear-to-coaxial duct transition assembly for a fuel-fired, direct vent heating appliance is fabricated by providing a one-piece rectangular sheet metal plenum box having a rear wall with first and second circular openings therein, and an open front side. A separate rectangular front wall of the plenum box is also formed and has a circular opening therein. Prior to assembling the plenum box, a rearwardly projecting combustion air stub duct is secured to the rear plenum box wall at the first opening therein, and a forwardly projecting combustion air intake duct is secured to the front plenum box wall at the opening therein. Cooperating side edge portions and flange pockets on the front wall and the open side of the plenum box and then interlocked and crimped to complete the plenum box. A flue gas discharge duct is then extended rearwardly through the front air intake duct to cause a rear end portion of the flue gas discharge duct to project outwardly through the second opening in the rear plenum box wall, and secured to the rear wall so that a front portion of the flue gas discharge duct extends coaxially through the interior of the forwardly projecting air intake duct. The coaxial front ducts may then be connected to a coaxial vent termination assembly, and the rear duct portions may be connected to the colinear flue gas discharge and combustion air intake ducts of a fuel-fired, direct vent heating appliance.

17 Claims, 3 Drawing Sheets

METHODS OF FABRICATING A VENT/ INTAKE SYSTEM FOR A FUEL-FIRED, DIRECT VENT HEATING APPLIANCE

BACKGROUND OF THE INVENTION

The present invention generally relates to venting and air intake structures for fuel-fired heating appliances and, in a preferred embodiment thereof, more particularly relates to methods of fabricating a vent/intake system, including a specially designed sheet metal colinear-to-coaxial duct transition assembly, for use in conjunction with a fuel-fired, direct vent heating appliance.

Fuel-fired, direct vent heating appliances, such as water heaters, fireplaces and furnaces, are typically provided with a first duct structure through which hot combustion gases from the appliance may be discharged, and a second duct structure through which combustion air may be drawn into the appliance. It is considered desirable for pressure balancing purposes to discharge a direct vent appliance's hot flue gases and draw its combustion air through a "concentric" duct termination structure—i.e., one in which the hot flue gas discharge duct is centrally disposed within a laterally larger combustion air intake duct). However, it is desirable for other purposes, such as preventing overheating of the incoming combustion air and preventing degradation of the appliance burner performance caused by flue gas leaking into the combustion air intake duct, to arrange the flue gas discharge and combustion air intake ducts in a "colinear" arrangement—i.e., one in which the two ducts are run separately from one another, with neither of the two ducts being disposed within the other duct.

Thus, to operatively connect the two colinear ducts to the coaxially arranged termination assembly, through which discharging flue gas and incoming combustion air are simultaneously flowed, the installation between the two ducts and the termination assembly of a coaxial-to-colinear transition conversion assembly is required to properly route the flue gas and combustion air flows between the colinear ducts and the termination assembly. AS conventionally fabricated, this type of conversion assembly is customarily formed from a bendable sheet metal material, with the fabrication of the conversion assembly typically presenting a tedious, relatively complex task which undesirably increases the overall cost of the vent/intake system.

Because of this, a need exists for simpler and less expensive methods of fabricating a vent/intake system for a fuel-fired, direct vent heating appliance, including a colinear-to-coaxial duct transition assembly of the general type described above. It is to this need that the present invention is directed.

SUMMARY OF THE INVENTION

In carrying out principles of the present invention, in accordance with a preferred embodiment thereof, a colinear-to-axial duct transition assembly for a fuel-fired direct vent heating appliance is fabricated in a simple, relatively inexpensive manner illustratively using sheet metal components and including the step of providing a plenum box having a rear wall with spaced apart first and second openings therein, and an open front side spaced apart from the rear wall in a first direction and having side edge portions. Preferably, the plenum box is of a one-piece construction. A rearwardly projecting first combustion air inlet duct is secured to the rear plenum box wall at the first rear wall opening and in communication with the interior of the plenum box.

A front wall member is provided, and has an opening therein, and side edge portions interlockable with the side edge portions of the plenum box. Representatively, some of the side edge portions of the front wall member and the plenum box are bent to form pocket areas which are configured to receive other, unbent side edge portions of these components. A second combustion air inlet duct is attached to a side portion of the front wall member at the opening therein.

Side edge portions of the front wall member and the plenum box, at its open front side, are interlocked in a manner causing the front wall member to cover the open front side of the plenum box, with the second combustion inlet air duct projecting forwardly from the front wall member and communicating with the interior of the plenum box. Portions of the interlocked side edge portions are then deformed in a manner anchoring the front wall member to the plenum box. While other interlocking and deforming techniques could be alternatively be utilized, the interlockable side edge portions are preferably configured in a manner such that the such side edge portions are interlocked in response to a relative movement of the plenum box and the front wall member in a direction transverse to the aforementioned first direction, and the interlocked side edge portions are illustratively deformed in a direction parallel to the first direction.

To complete the fabrication of the transition assembly, a flue gas discharge duct is provided and is extended rearwardly through the second combustion air inlet duct, the interior of the plenum box, and the second opening in the rear plenum box wall so that a front longitudinal portion of the flue gas discharge duct is coaxially disposed within the second combustion air duct and a rear longitudinal portion of the flue gas discharge duct projects rearwardly beyond the rear wall of the plenum box. The inserted flue gas discharge duct is then anchored to the rear wall of the plenum box.

In one embodiment of the method, the flue gas discharge duct has a rear end, and an annular external bead formed thereon inwardly adjacent a rear end thereof, the extending step is performed in a manner positioning the annular external bead against the inner side surface of the rear plenum box wall with the rear end of the flue gas discharge duct projecting outwardly from the rear wall of the plenum box, and the anchoring step is performed by circumscribing a front end portion of the flue gas discharge duct with a generally annular fastening member, moving the fastening member rearwardly along the flue gas discharge duct, through the interior of the second combustion air inlet duct, until the fastening member forwardly overlies the annular external bead, and then securing the fastening member to the rear wall of the plenum box. In another embodiment of the method, the fastening member is eliminated, and the inserted flue gas discharge duct is anchored to the rear plenum box wall by radially outwardly deforming the rear end of the flue gas discharge duct so that it rearwardly overlies the rear wall of the plenum box.

Representatively, the sheet metal flue gas discharge duct and first and second combustion air inlet ducts have welded seams extending along their lengths. After completion of the colinear-to-coaxial duct transition assembly, a front end portion of the flue gas discharge and the second combustion air inlet duct may respectively be telescoped with coaxial vent and intake portions of a vent termination assembly, and the intake and vent duct portions projecting rearwardly from the plenum box may be respectively communicated with the intake and vent openings of a fuelfired direct vent heating appliance. Preferably, to facilitate the connection of the transition assembly to the vent termination assembly, the outer end of the termination assembly inlet duct portion is crimped around its circumference, an annular external bead is formed on the vent duct portion of the termination assembly, and the vent and inlet duct portions of the termination assembly are respectively telescoped into the front vent and inlet duct portions of the transition assembly.

DETAILED DESCRIPTION

Figure 1:
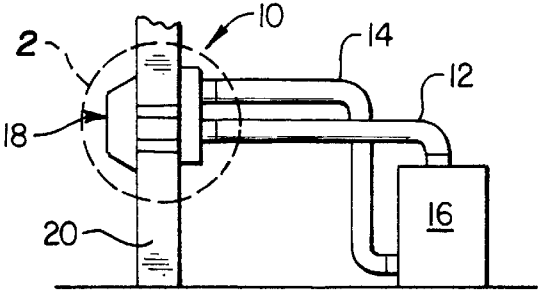
FIG. 1 is a simplified schematic side elevational view of a representative fuel-fired, direct vent heating appliance to which is connected a colinear-to-coaxial duct transition assembly embodying principles of the present invention.
Figure 3:
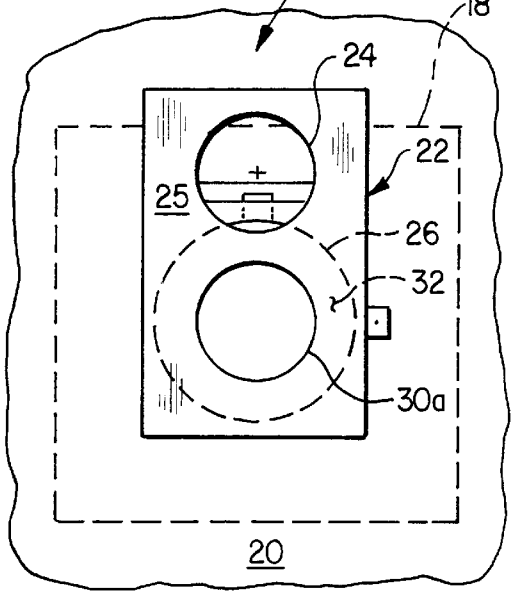
FIG. 3 is a rear side elevational view of the transition assembly taken generally along line 3—3 of FIG. 2.
Figure 2:
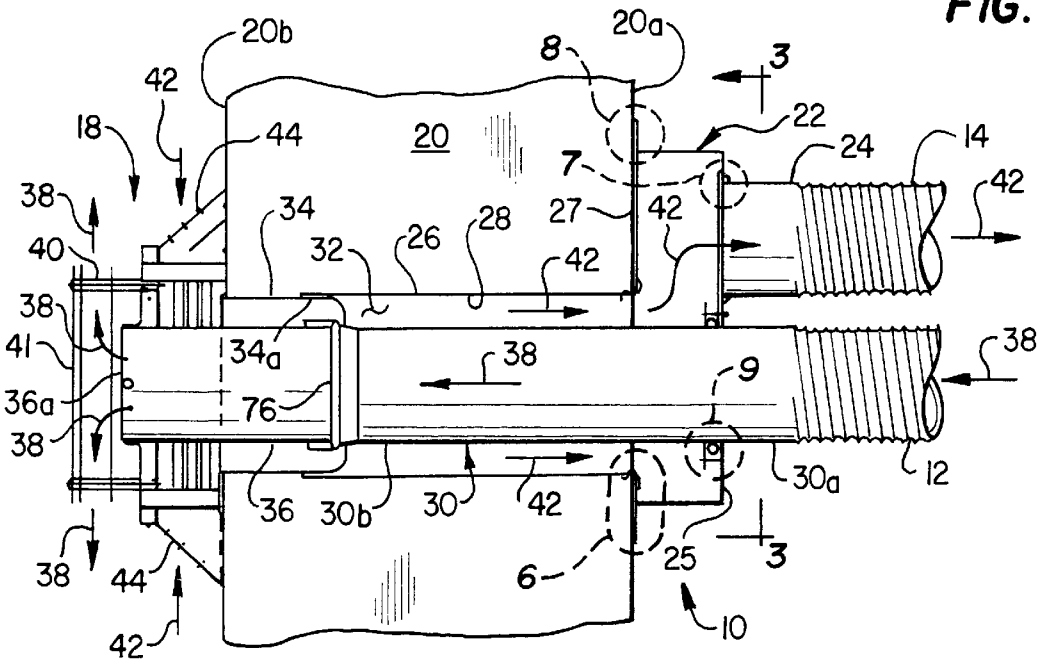
FIG. 2 is an enlargement of the dashed circle area "2" in FIG. 1.
Figure 4:
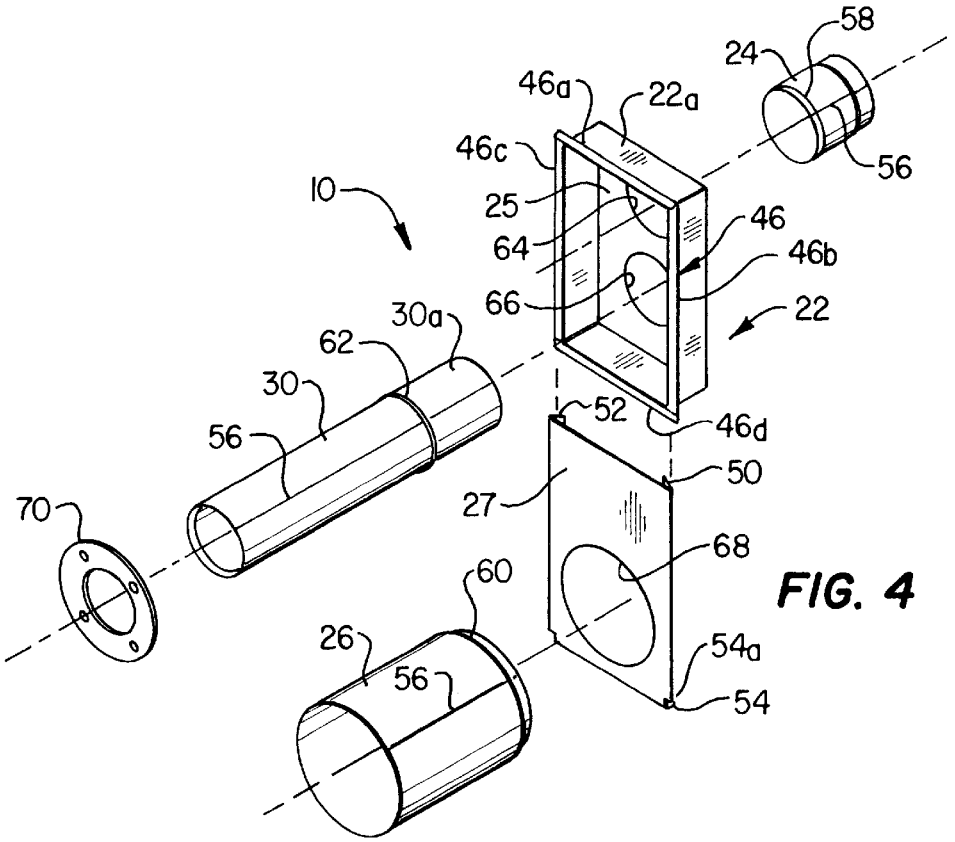
FIG. 4 is an exploded perspective view of the duct transition assembly.
Figure 5:
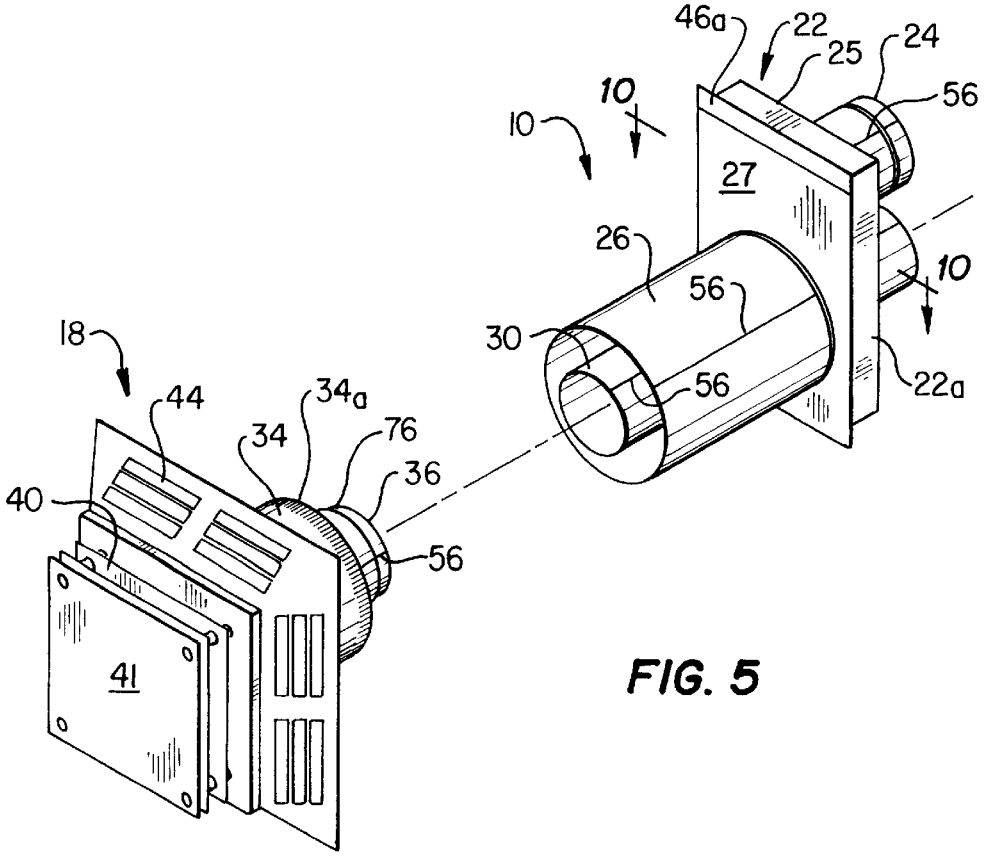
FIG. 5 is a partially exploded view of the duct transition assembly and a conventional vent termination assembly to which it is representatively connected.

As illustrated in FIGS. 1–3, the present invention provides a colinear-to-coaxial duct transition assembly 10 used to operatively connect the colinear hot flue gas discharge and combustion air intake ducts 12,14 of a fuel-fired heating appliance 16, such as a water heater, fireplace or furnace, to a conventional direct vent termination assembly 18 mounted exteriorly on an outside wall 20 of the building in which the appliance 16 is installed.

In the fuel-fired appliance vent industry, with reference to air intake and combustion gas discharge ducts connected to a heating appliance, the term "coaxial" means that the hot flue gas discharge duct is centrally disposed within the laterally larger combustion air intake duct, and the term "colinear" means that these two ducts are run separately from one another—i.e., neither duct is disposed within the other duct.

While it is desirable for pressure balancing purposes to discharge a direct vent appliance's hot flue gases and draw its combustion air from a concentric direct vent termination assembly, such as the illustrated conventional termination assembly 18, it is desirable for other purposes, such as preventing overheating of the incoming combustion air and preventing degradation of the appliance burner performance caused by flue gas leaking into the combustion air intake duct, to arrange the flue gas discharge and combustion air intake ducts 12,14 in the illustrated colinear arrangement.

TO this end, and still referring to FIGS. 1–3, the present invention provides the specially configured transition assembly 10 which includes a generally rectangular plenum box 22 mounted on the interior side 20*a* of the outside wall 20. Connected to the plenum box 22 are:

(1) a combustion air connection stub duct 24 which extends rightwardly from the right side wall of the plenum box 22 and communicates with its interior;

(2) a combustion air intake duct 26 extending leftwardly from the left side wall of the plenum box 22 through a horizontal portion of a corresponding opening 28 formed through the outside wall 20, the duct 26 communicating with the interior of the plenum box 22; and (3) a hot flue gas discharge duct 30 extending through the interior of the plenum box 22 and having a right end portion defining, on the right side wall of the plenum box 22, a flue gas discharge connection stub duct 30*a*, and a left end portion 30*b* extending coaxially through the combustion air intake duct 26 and defining therewith an annular space 32.

The conventional direct vent termination assembly 18 mounted on the exterior side 20*b* of the outside wall 20 has, on its right or inner side, a combustion air duct 34 that extends rightwardly through the wall opening 28 and slidingly telescopes with the transition assembly combustion air duct 26 therein, and a hot flue gas discharge duct 36 that coaxially extends through the duct 34, slidingly telescopes with the transition assembly flue gas discharge duct 30, and has an open left end 36*a*. This slidingly telescoped duct interconnection between the transition assembly 10 and the conventional termination assembly 18 conveniently permits the overall structure 10,18 to be horizontally adjusted to accommodate variations in the thickness of the outside wall 20.

With the transition and termination assemblies 10,18 in place on the outside wall 20, the ducts 12,14 from the appliance 16 are respectively connected to the transition assembly stub duct portions 30*a*, 24 as shown. During firing of the appliance 16, hot flue gases 38 from the appliance 16 are sequentially flowed from the appliance 16 to the outside of the building through the duct 12, the transition assembly duct 30, the termination assembly duct 36, and outwardly through a discharge opening area 40 at the left or outer side of the termination assembly 18. At the same time, outside combustion air 42 is drawn into the appliance 16 sequentially via an intake area 44 of the termination assembly 18, the annular area 32 between the coaxial ducts within the wall opening 28, the interior of the plenum box 22, and the combustion air intake duct 14.

Thus, the transition assembly 10 of the present invention conveniently provides for the simple interconnection between the colinear flue gas discharge and combustion air intake ducts 12,14 connected to the appliance 16, and the coaxially ducted direct vent termination assembly 18.

With primary reference now to FIGS. 4–10, the plenum box 22 is made up of an open-sided rectangular base portion 22*a* formed from a single metal sheet and having a flange 46 extending around its open front side. The top edge 46*a* of the flange 46 (see FIG. 4) is bent forwardly and downwardly to form a downwardly facing pocket area 48 (see FIG. 8). The front plenum box wall 27 has, on opposite vertical edge portions thereof, rearwardly and inwardly turned flanges 50,52 which form vertical pockets 50*a*,52*a* (see FIG. 10). Wall 27 has a rearwardly and upwardly bent lower end flange 54 which forms an upwardly facing pocket area 54*a* (see FIG. 6).

The tubular sheet metal ducts 24, 26 and 30 have welded seams 56 along their lengths, the duct 24 has an annular external bead 58 adjacent its front end, duct 26 has an annular external bead 60 adjacent its rear end, and duct 30 has an annular external bead 62 inwardly offset from its rear end. For purposes later described, the rear wall 25 of the plenum box base portion 22*a* has upper and lower circular holes 64 and 66 formed in its rear side wall 25, and the front plenum box wall 27 has a circular hole 68 formed in a lower end portion thereof.

As will now be described, according to a key aspect of the present invention, a unique method is provided for quickly and economically fabricating the transition assembly 10. First, the rear end of the duct 26 is inserted rearwardly through the hole 68 in the front plenum box wall 27 until the bead 60 engages the front side of the wall 27 (see FIG. 6). From the rear side of the wall 27 the rear end of the duct 60 is radially outwardly turned to form a roll lock flange 60*a* to thereby anchor the duct 26 on the front wall 27. Next, the duct 24 is forwardly inserted into the upper hole 64 in the transition box rear wall 25 until the bead 58 rearwardly abuts the wall 25 (see FIG. 7). From the front side of the rear wall 25 an annular roll lock flange 24*a* is then formed on the front end of the duct 24 to lock the duct 24 in place on the wall 25.

Figure 6:
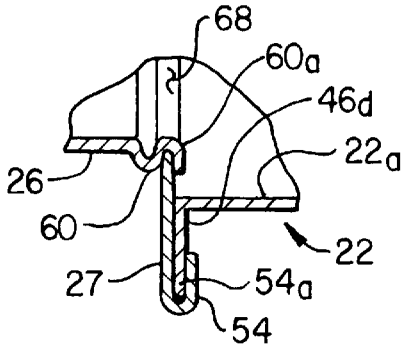
FIG. 6 is an enlarged scale cross-sectional detail view of the dashed circle area "6" in FIG. 2.
Figure 7:
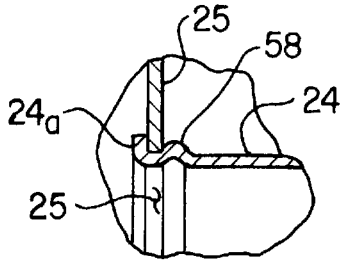
FIG. 7 is an enlarged scale cross-sectional detail view of the dashed circle area "7" in FIG. 2.
Figure 8:
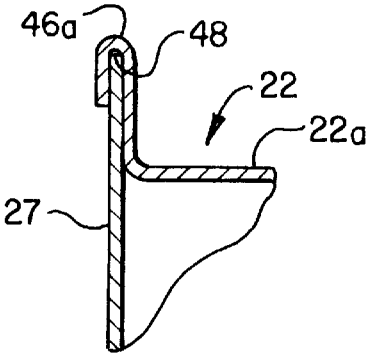
FIG. 8 is an enlarged scale cross-sectional detail view of the dashed circle area "8" in FIG. 2.

Next, the front transition box wall 27 is slid upwardly into place on the open front side of the transition box base portion 22*a* by downwardly inserting the base portion vertical flanges 46*b*,46*c* into the vertical flange pockets 50*a*,52*a* (see FIG. 10) until the upper edge of the wall 27 is received in the flange pocket 48 (see FIG. 8), and the bottom base portion flange 46*d* enters the front wall flange pocket 54*a* (see FIG. 6). The overlapped flange portions of the wall 27 and the base portion 22*a* are then horizontally crimped in a front-to-rear direction to anchor the front wall 27 to the front side of the transition box base portion 22*a*.

Figure 9:
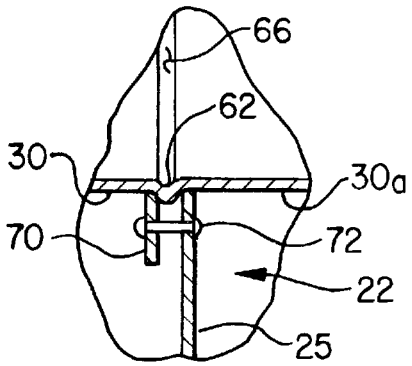
FIG. 9 is an enlarged scale cross-sectional detail view of the dashed circle area "9" in FIG. 2.
Figure 9A:
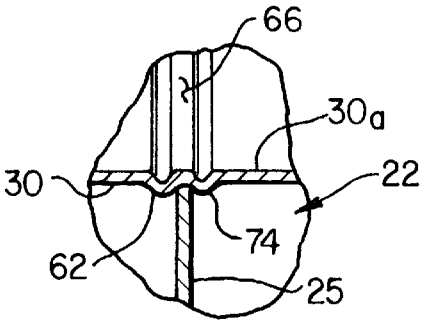
FIG. 9A is an enlarged scale cross-sectional detail view similar to that in FIG. 9, but illustrating an alternate version of the fabrication step shown in FIG. 9.
Figure 10:
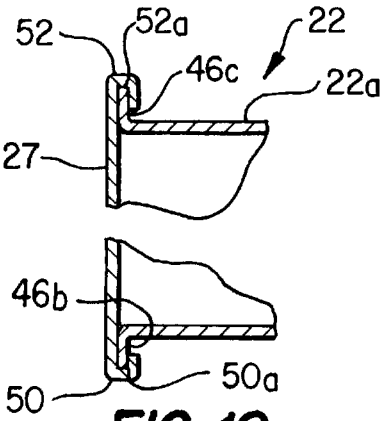
FIG. 10 is an enlarged scale fragmentary cross-sectional view through the completed transition assembly taken along line 10—10 of FIG. 5.

The duct 30 is then rearwardly inserted through the duct 26 until the rear portion 30*a* of the duct 30 rearwardly passes through the hole 66 in the rear wall 25 of the base portion 22*a* and the bead 62 is rearwardly brought into engagement with the front side of the rear wall 25 (see FIG. 9). An annular retainer plate 70 is then slid inwardly over the duct 30 until the plate 70 contacts the bead 62 on the duct 30 (see FIG. 9). The inserted plate 70 is then anchored to the rear base housing wall 25 using fasteners 72 such as pop rivets. This locks the duct 30 to the rear base housing wall 25. Alternately, as illustrated in FIG. 9A, instead of using the plate 70, an annular external bead 74 may be formed on the duct 30 just rearwardly of the rear base portion wall 25 (using a suitable swaging tool inserted into the duct 30 through its rear end) to lock the duct 30 to the wall 25.

This completes the fabrication of the transition assembly 10. The completed assembly 10 is then connected through the wall opening 28 (see FIG. 2) by telescoping the termination assembly duct 36 into the transition assembly duct 30, and telescoping the termination assembly duct 34 into the transition assembly duct 26. An annular external bead 76 formed on the termination assembly duct 36 locks the duct 36 within the duct 30 and forcibly "rounds" out the ducts 30,34 at their juncture, and the end 34*a* of the duct 34 is slightly crimped to facilitate its entry into the duct 30.

The foregoing detailed description is to be clearly understood as being given by way of illustration and example, the spirit and scope of the present invention being limited solely by the appended claims.

What is claimed is:

1. A method of fabricating a colinear-to-coaxial duct transition assembly for a fuel-fired, direct vent heating appliance, said method comprising the steps of:

providing a plenum box having a rear wall with spaced apart first and second openings therein, and an open front side spaced apart from said rear wall in a first direction and having side edge portions;

securing a rearwardly projecting first combustion air inlet duct to said rear wall at said first opening and in communication with the interior of said plenum box;

providing a front wall member having an opening therein and side edge portions interlockable with said side edge portions of said plenum box;

attaching a second combustion air inlet duct to a side portion of said front wall member at said opening therein;

interlocking said side edge portions of said front wall member and said plenum box in a manner causing said front wall member to cover said open front side of said plenum box, with said second combustion inlet air duct projecting forwardly from said front wall member and communicating with the interior of said plenum box;

deforming portions of the interlocked side edge portions in a manner anchoring said front wall member to said plenum box;

providing a flue gas discharge duct;

extending said flue gas discharge duct rearwardly through said second combustion air inlet duct, the interior of said plenum box, and said second opening in said rear wall so that a front longitudinal portion of said flue gas discharge duct is coaxially disposed within said second combustion air duct and a rear longitudinal portion of said flue gas discharge duct projects rearwardly beyond said rear wall; and anchoring said flue gas discharge duct to said rear wall.

2. The method of claim 1 wherein:

said step of providing a plenum box includes the step of forming a one-piece sheet metal plenum box structure.

3. The method of claim 1 wherein said securing step includes the steps of:

forming an annular exterior bead on the first combustion air inlet duct inwardly adjacent a first end thereof, extending said first end forwardly through said first opening to cause said annular exterior bead to abut the exterior side surface of said rear wall, and then radially outwardly deforming said first end within the interior of said plenum box.

4. The method of claim 1 wherein:

said securing step is performed using a tubular sheet metal duct having a welded seam extending along its length.

5. The method of claim 1 wherein said attaching step includes the steps of:

forming an annular exterior bead on the second combustion air inlet duct inwardly adjacent a first end thereof, extending said first end through said opening in said front wall member from a first side thereof to a second side thereof in a manner causing said annular exterior bead to abut said first side, and then radially outwardly deforming said first end of said second combustion air inlet duct.

6. The method of claim 1 wherein:

said attaching step is performed using a tubular sheet metal duct having a welded seam extending along its length.

7. The method of claim 1 wherein:

said interlocking step is performed by moving one of said plenum box and said front wall member relative to the other of said plenum box and said front wall member in a second direction transverse to said first direction, and said deforming step is performed by deforming portions of the interlocked side edge portions in said first direction.

8. The method of claim 1 wherein said interlocking step includes the steps of:

bending some of said side edge portions of said plenum box and said front wall members to form pocket areas, and inserting others of said side edge portions of said plenum box and said front wall member into said pocket areas.

9. The method of claim 1 wherein:

said step of providing a flue gas discharge duct is performed using a tubular sheet metal duct having a welded seam extending along its length.

10. The method of claim 1 wherein:

said flue gas discharge duct has a rear end, and an annular external bead formed thereon inwardly adjacent said rear end, said extending step is performed in a manner positioning said annular external bead against the inner side surface of said rear wall with said rear end of said flue gas discharge duct projecting outwardly from said rear wall of said plenum box, and said anchoring step is performed by circumscribing a front end portion of said flue gas discharge duct with a generally annular fastening member, moving said fastening member rearwardly along said flue gas discharge duct, through the interior of said second combustion air inlet duct, until said fastening member forwardly overlies said annular external bead, and then securing said fastening member to said rear wall of said plenum box.

11. The method of claim 1 wherein:

said flue gas discharge duct has a rear end, and an annular external bead formed thereon inwardly adjacent said rear end, said extending step is performed in a manner positioning said annular external bead against the inner side surface of said rear wall with said rear end of said flue gas discharge duct projecting outwardly from said rear wall of said plenum box, and said anchoring step is performed by radially outwardly deforming said rear end of said flue gas discharge duct.

12. A method of fabricating a vent and intake duct system for a fuel-fired direct vent heating appliance, said method comprising the steps of:

providing a plenum box structure having:

a hollow body portion with a front wall with an opening therein, a rear wall with a first opening therein and a second opening spaced apart from said first opening and aligned with said front wall opening, a first combustion air inlet stub duct secured to said rear wall at said first opening, projecting outwardly from said rear wall, and communicating with the interior of said hollow body portion, and a second combustion air inlet stub duct secured to said front wall at said opening therein, projecting outwardly from said front wall, and communicating with the interior of said hollow body portion;

providing a flue gas discharge duct;

extending said flue gas discharge duct rearwardly through said second combustion air inlet stub duct, the interior of said hollow body portion, and said second opening in said rear wall so that a front longitudinal portion of said flue gas discharge duct is coaxially disposed within said second combustion air inlet stub duct and a rear longitudinal portion of said flue gas discharge duct projects rearwardly beyond said rear wall; and anchoring said flue gas discharge duct to said rear wall.

13. The method of claim 12 further comprising the steps of:

providing a vent termination assembly having coaxial vent and intake duct portions, and telescopingly connecting a front end portion of said flue gas discharge duct and said second combustion air inlet stub duct, respectively, to said coaxial vent and intake duct portions of said vent termination assembly.

14. The method of claim 13 wherein:

said method further comprises the steps of:

crimping an outer end portion of said intake duct portion of said vent termination assembly, and forming an annular external bead on an outer end portion of said vent duct portion, and said telescopingly connecting step is performed by telescoping said vent and intake duct portions of said vent termination assembly, respectively, into said front end portion of said flue gas discharge duct and said second combustion air inlet stub duct.

15. The method of claim 13 further comprising the steps of:

communicating said first combustion air inlet stub duct with an air inlet portion of a fuel-fired direct vent heating appliance.

16. The method of claim 12 wherein:

said flue gas discharge duct has a rear end, and an annular external bead formed thereon inwardly adjacent said rear end, said extending step is performed in a manner positioning said annular external bead against the inner side surface of said rear wall with said rear end of said flue gas discharge duct projecting outwardly from said rear wall of said plenum box, and said anchoring step is performed by circumscribing a front end portion of said flue gas discharge duct with a generally annular fastening member, moving said fastening member rearwardly along said flue gas discharge duct, through the interior of said second combustion air inlet duct, until said fastening member forwardly overlies said annular external bead, and then securing said fastening member to said rear wall of said plenum box.

17. The method of claim 12 wherein:

said flue gas discharge duct has a rear end, and an annular external bead formed thereon inwardly adjacent said rear end, said extending step is performed in a manner positioning said annular external bead against the inner side surface of said rear wall with said rear end of said flue gas discharge duct projecting outwardly from said rear wall of said plenum box, and said anchoring step is performed by radially outwardly deforming said rear end of said flue gas discharge duct.

* * * * *